United States Patent [19]

White et al.

[11] 4,348,957

[45] Sep. 14, 1982

[54] BOATTAIL EMERGENCE BY EJECTING NOZZLE EXIT CONE

[75] Inventors: James W. White, Huntsville, Ala.; Joseph J. McDermott, deceased, late of Huntsville, Ala., by Rosalie L. McDermott, executrix

[73] Assignee: The United States of America as represented by the Secretary of the Army, Washington, D.C.

[21] Appl. No.: 172,879

[22] Filed: Jul. 28, 1980

[51] Int. Cl.[3] ..... F42B 15/10

[52] U.S. Cl. ..... 102/378; 60/271

[58] Field of Search ..... 102/377, 378; 60/271

[56] References Cited

U.S. PATENT DOCUMENTS

| | | | |
|---|---|---|---|
| 2,710,523 | 6/1955 | Purvis | 60/271 |
| 3,122,098 | 2/1964 | Glennan | 102/378 |
| 3,139,031 | 6/1964 | Schroter et al. | 102/378 |
| 3,257,804 | 6/1966 | Thomas et al. | 102/378 |
| 3,292,542 | 12/1966 | White | 102/378 X |
| 3,535,882 | 10/1970 | Tizio et al. | 60/271 |
| 4,109,581 | 8/1978 | Six | 102/501 |
| 4,280,408 | 7/1981 | Weber et al. | 102/501 |

*Primary Examiner*—Harold J. Tudor

*Attorney, Agent, or Firm*—Nathan Edelberg; Robert P. Gibson; James T. Deaton

[57] ABSTRACT

A device for altering the after body shape of a missile configuration so as to reduce the ballistic flight drag coefficient after booster burnout and including linear shaped charge cutting device for severing a portion of a nozzle exit cone just aft of a fixed boattail configuration on the outer surface of the missile to allow boundary layer air flow to flow smoothly over the boattail and thereby reduce the base drag on the missile during the coast phase thereof.

2 Claims, 3 Drawing Figures

BOATTAIL EMERGENCE BY EJECTING NOZZLE EXIT CONE

DEDICATORY CLAUSE

The invention described herein may be manufactured, used, and licensed by or for the Government for governmental purposes without the payment to us of any royalties thereon.

BACKGROUND OF THE INVENTION

In the past, boattail configurations were created by reducing the exit diameter of the main motor nozzle to provide a space for the boattail. This is not desirable in that the diameter at the exit end of the nozzle must be as large as the diameter of the rocket motor or nearly as large as the diameter of the rocket motor in order to insure maximum motor performance at boost. Therefore, previous considerations of a boattailed configuration at the end of a missile were unacceptable. Therefore, it is seen that some other approach to providing a missile with a boattail is needed.

Accordingly, it is an object of this invention to provide a missile with a boattail by severing a portion of the motor nozzle after burnout of the rocket motor by severing or cutting a portion of the rocket nozzle off to leave a boattail configuration on the outer surface of the missile.

Another object of this invention is to provide a missile with a structure in which the boattail arrangement can be provided and at the same time have a motor nozzle exit end with a diameter as large as the diameter of the rocket motor.

Other objects and advantages of this invention will be obvious to those skilled in this art.

SUMMARY OF THE INVENTION

In accordance with this invention, a missile is provided that has a rocket motor with a nozzle exhaust connected thereto with the internal diameter of the rocket motor being substantially the same as the exit end of the nozzle. The outer shape of the missile includes a cylindrical portion and a rear adjacent portion that tapers inwardly and then outwardly to an end of the nozzle. At the juncture of the surface that tapers inwardly and then outwardly, an explosive means severing device is placed with timer means for causing the explosive means to be ignited and sever the outwardly tapering portion of the nozzle to leave a boattail end of the missile to provide means for reducing base drag during the coast phase of the missile while in flight. By providing this configuration, the boundary layer of air flows smoothly over the boattail of the missile.

DESCRIPTION OF THE PREFERRED EMBODIMENT

Figure 1:
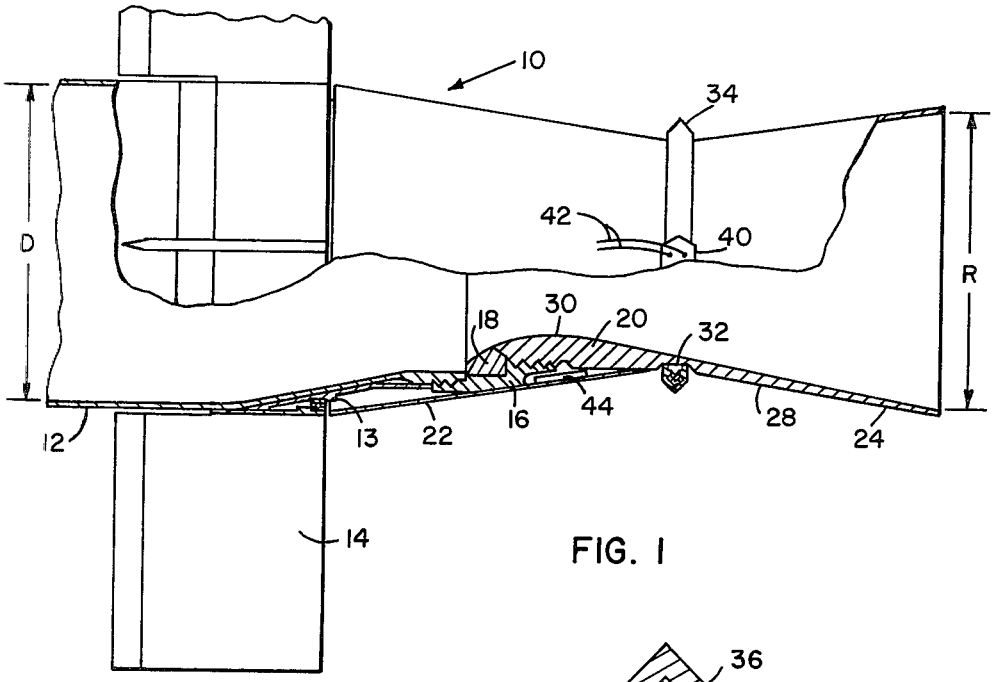
FIG. 1 is a cutaway portion of a missile in accordance with this invention and illustrating a portion of the missile in section.
Figure 2:
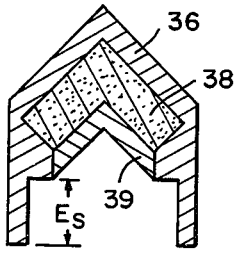
FIG. 2 is a cross-sectional view taken perpendicular of the linear shaped charge cutting device used in this invention.

Referring now to the drawing, a missile 10 in accordance with this invention is illustrated that has a rocket motor section 12 with an internal diameter D and a tapered end structure that is adapted to receive support structure 13 that has aerodynamic surface or fins 14 mounted thereon in a conventional manner. An adapter 16 is threaded on the end of the rocket motor structure and helps support supporting structure 13. An insert 18 is mounted inside adapter 16 and forms a portion of the nozzle structure. The remaining nozzle structure 20 is threaded to adapter 16 to complete the nozzle structure for the rocket motor. The end internal diameter R of the rocket nozzle is the same as diameter D of the rocket motor or they are almost nearly equal. By providing these diameters the same, this insures maximum motor performance at boost. Conventional rocket motor propellant for housing 12 is provided in practice but not illustrated herein.

A boattail outer housing structure 22 is secured to adapter 16 in a conventional manner to form a boattail structure for the missile when end structure 24 of the rocket nozzle is severed. It is also pointed out that boattail structure 22 is approximately 1-caliber in length and of a length which is approximately equal to diameter D. Boattail structure 22 has an outer surface 26 that tapers inwardly to a point of tangency to outer surface 28 of end portion 24. As noted, end portion 24 is somewhat aft of main motor nozzle throat 30. At the point of tangency between surfaces 26 and 28, the nozzle has a circumferential groove 32 therearound to weaken the nozzle structure. A linear shaped charge 34 is mounted circumferentially relative to groove 32 and provides means for cutting and severing the rear nozzle portion with tapered surface 28 to provide the missile a boattail structure after the missile has been launched in a boost phase and is in a coast phase. Linear shaped charge 34 includes a housing structure 36 that can be made of metal and houses a generally V-shaped explosive charge 38 inside housing 36 and has a concave liner 39 of inert material and preferably of metal which backs or seals explosive charge 38 with housing structure 36. A stand-off distance $E_s$ of about 0.1 inches to about 0.23 inches is provided by housing 36 to provide a stand-off distance between groove 32 of the rocket nozzle and explosive housing structure 36 which contains explosive 38. Explosive 38 has a conventional igniter means 40 (see FIG. 1) and is electrically ignited through leads 42 from power source and timer 44 mounted inside boattail structure 22.

Figure 3:
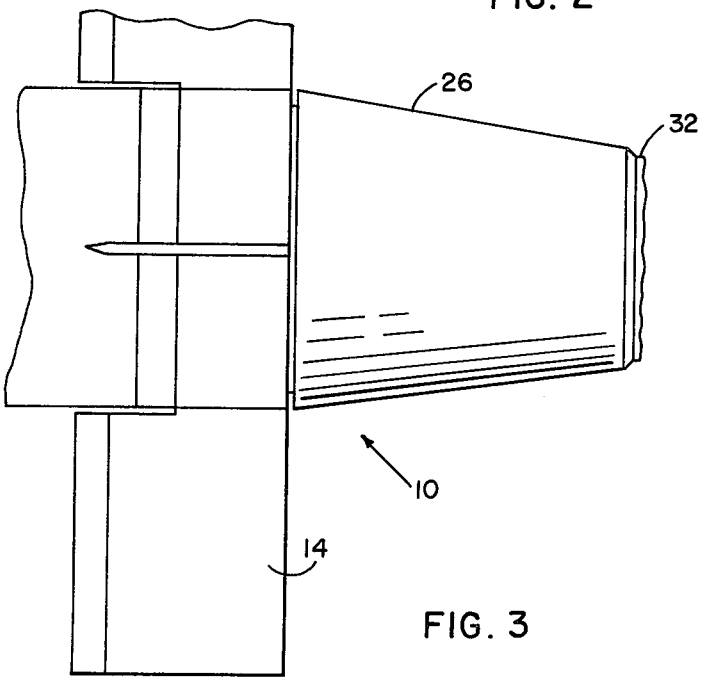
FIG. 3 is a partially cutaway view of the missile in accordance with this invention and illustrating the missile with the boattail portion after the nozzle end portion has been removed.

In operation, the rocket motor is ignited and thrust develops to launch the rocket in its predetermined flight trajectory. At the time of booster burnout or rocket motor burnout, a timer within package 44 which has been pre-programmed causes an electric charge to be sent through leads 42 to igniter 40 which sets off shaped charge 38 which is circumferentially of the rocket nozzle. When explosive 38 of the shaped charge which is circumferentially of the rocket nozzle is set off, a detonation wave travels forward toward the rocket nozzle and metal liner 39 collapses starting at the apex. The collapse of liner 39 results in the ejection of a long narrow jet of the products of the explosion and metal particules from the surface of the liner at supersonic velocities. Liner 39 need not be metal, however, 15% more penetration can be gained by the use of metal liners depending upon the particular application. If deep penetration or cutting is required, metal is used. Within about 15 microseconds after ignition, cutting begins and within approximately 34 microseconds, the pressure from the explosion spreads radially from the linear shaped charge and the container burst and severs the end portion of the rocket nozzle to provide the tapered boattail end structure 26 illustrated in FIG. 3. This boattail end structure configuration of the missile is highly effective in reducing drag and as much as 30% range increase over non-boattail configurations can be attained in coast phase of missile flight.

As can be seen, this invention clearly reduces the drag coefficient and has the advantage of permitting the missile system to achieve its designed top performance at boost and also the needed low drag profile during the coast phase of flight.

It is claimed:

1. A missile having a rocket motor structure with a nozzle structure attached thereto, said nozzle structure having an outwardly tapering outer surface, a frustaconical boattail structure mounted over and about an end portion of said rocket motor structure and a forward portion of said rocket nozzle structure, said boattail structure having an outward surface that tapers inwardly from a forward portion to a point of tangency with the outwardly tapering outer surface of said rocket nozzle, means about said rocket nozzle at said point of tangency and mounted relative to the rocket nozzle, means for causing said portion of said rocket nozzle with said outwardly tapering surface to be separated from the remainder of said rocket nozzle structure by said means about said rocket nozzle at said tangency point to cause a boattail end structure of about 1-caliber in length to be formed on said missile, said rocket motor having a predetermined internal diameter and said rocket motor nozzle having a predetermined internal diameter at an exit end of said rocket nozzle which is substantially equal to said predetermined internal diameter of said rocket motor, said means about said rocket nozzle at said point of tangency being a shaped charge that is spaced a predetermined distance from said rocket motor nozzle and has means for setting off said shaped charge at the appropriate time to sever said nozzle end structure and leave said boattail structure on the missile, and said means for setting off said shaped charge including a power supply and timing means that are inner connected to said shaped charge to cause said shaped charge to be set off at the appropriate time.

2. A missile as set forth in claim 1, wherein said rocket nozzle structure has a weakened area about the circumference thereof at said point of tangency, and said means about said rocket nozzle being mounted at said weakened area.

* * * * *